US008789783B2

(12) United States Patent
Xu et al.

(10) Patent No.: US 8,789,783 B2
(45) Date of Patent: Jul. 29, 2014

(54) SHREDDER WITH SHOCK ABSORBING ELEMENT

(75) Inventors: Qing Kui Xu, Hubei (CN); Jason Jia, Jiangsu (CN)

(73) Assignee: Fellowes, Inc., Itasca, IL (US)

( * ) Notice: Subject to any disclaimer, the term of this patent is extended or adjusted under 35 U.S.C. 154(b) by 456 days.

(21) Appl. No.: 13/144,657

(22) PCT Filed: Jan. 14, 2009

(86) PCT No.: PCT/CN2009/000048

§ 371 (c)(1),
(2), (4) Date: Jan. 26, 2012

(87) PCT Pub. No.: WO2010/081251

PCT Pub. Date: Jul. 22, 2010

(65) Prior Publication Data

US 2012/0111981 A1 May 10, 2012

(51) Int. Cl.
*B02C 23/00* (2006.01)
*B02C 19/00* (2006.01)

(52) U.S. Cl.
USPC ..... 241/100; 241/101.2

(58) Field of Classification Search
USPC ..... 241/101.2, 100, 236; 267/141
See application file for complete search history.

(56) References Cited

U.S. PATENT DOCUMENTS 4,172,590 A * 10/1979 Jarret et al. ..... 267/149
5,035,366 A 7/1991 Hashimoto et al.
5,358,210 A * 10/1994 Simon et al. ..... 248/628
6,254,070 B1 * 7/2001 Runge ..... 267/152
6,695,296 B1 * 2/2004 Runge ..... 267/160
7,040,559 B2 5/2006 Matlin et al.
7,303,184 B1 * 12/2007 Bower et al. ..... 267/136
7,311,276 B2 12/2007 Matlin et al.
7,344,096 B2 3/2008 Matlin et al.

(Continued)

FOREIGN PATENT DOCUMENTS

CN 2291212 Y 9/1998
CN 2838750 Y 11/2006

(Continued)

OTHER PUBLICATIONS

International Search Report and Written Opinion for PCT International Patent Application No. PCT/CN2009/000048, mailed Oct. 22, 2009.

(Continued)

*Primary Examiner* — Faye Francis
(74) *Attorney, Agent, or Firm* — Pillsbury Winthrop Shaw Pittman LLP

(57) ABSTRACT

Disclosed herein is a shredder with a shredder housing and a shredder mechanism received in the housing, the shredder mechanism enabling the at least one article to be shredded to be fed into cutter elements and a motor being operable to drive the cutter elements in a shredding direction. The shredder also includes at least one shock absorbing element configured to connect the shredder mechanism and shredder housing. The shock absorbing element has a first leg connected to the shredder mechanism, a second leg connected to the shredder housing, and a resilient section interconnecting the first and second legs in a spaced apart relation, so that the shock absorbing element may at least reduce vibrations transmitted from the shredder mechanism to the shredder housing during operation of the shredder.

14 Claims, 7 Drawing Sheets

(56) References Cited

U.S. PATENT DOCUMENTS

| | | | | |
|---|---|---|---|---|
| 8,262,068 | B1 * | 9/2012 | Monson et al. | 267/292 |
| 8,516,790 | B2 * | 8/2013 | Hogie | 60/226.2 |
| 2002/0105124 | A1 | 8/2002 | Monson et al. | |

FOREIGN PATENT DOCUMENTS

| | | | |
|---|---|---|---|
| CN | 200998684 | Y | 1/2008 |
| CN | 201076825 | Y | 6/2008 |
| CN | 201105230 | | 8/2008 |
| CN | 201105230 | Y | 8/2008 |
| CN | 101259447 | A | 9/2008 |
| JP | 10306843 | A | 11/1998 |
| JP | 2004340301 | A1 | 2/2004 |
| KR | 100696582 | B1 | 3/2007 |
| WO | 2010081250 | A1 | 7/2010 |

OTHER PUBLICATIONS

International Preliminary Report on Patentability for PCT International Patent Application No. PCT/CN2009/000048, mailed Apr. 18, 2011.

Chinese Office Action for Chinese Application No. 200980157194.3, issued on Apr. 23, 2013, 14 pages.

Chinese Office Action for Chinese Application No. 200980154417.0, issued Mar. 27, 2013, 14 pages.

Chinese Office Action for Chinese Application No. 200980154417.0, mailed Sep. 29, 2013,14 pages.

* cited by examiner

SHREDDER WITH SHOCK ABSORBING ELEMENT

CROSS REFERENCE TO RELATED APPLICATIONS

This is the U.S. National Phase of PCT/CN2009/000048, filed Jan. 14, 2009, the entire contents of which is incorporated by reference herein in its entirety.

BACKGROUND

1. Field of Invention

The present invention is generally related to a shredder having a shock absorbing element for reducing the transmission of at least vibrations from a shredder mechanism to a housing.

2. Description of Related Art

A common type of shredder has a shredder mechanism contained within a housing and mounted atop a container. The shredder mechanism typically includes a cutting head assembly including a series of cutter elements that shred articles such as paper, CDs, DVDs, credit cards, and the like that are fed therein and discharge the shredded articles downwardly into is the container. An example of such a shredder may be found, for example, in U.S. Pat. No. 7,040,559, which is herein incorporated by reference in its entirety.

During operation of the shredder (e.g., when users feed articles to be shredded into the shredder mechanism), the cutter element of the shredder mechanism are generally rotating or moving about shafts therein. Such movement or rotation may cause forces to be transferred from the shredder mechanism to the shredder housing, thereby causing vibrations or shaking of the device, as well as the possibility of noise and/or rocking, which is not desirable. Furthermore, when shredders are operated when a bin is near capacity (e.g., when bin is near being full of shredded particles), the machine may be subject to knocking and/or rocking, which is not desirable. It may be beneficial to reduce or eliminate such noise and vibrations in the working environment as they may be undesirable to one or more users.

To assist in preventing noise and vibration that affects the housing, some shredders provide springs adjacent or near a connection point between the shredder mechanism (or cutting head assembly) and the housing. Chinese Patent Publications CN 2291212Y and CN 2838750Y illustrate examples of such systems. However, it is still desirable to further improve upon the reduction of noise and vibration in the shredder, as well as reduce rocking and knocking.

SUMMARY

An aspect of the invention provides a shredder including a shredder housing having a throat for receiving at least one article to be shredded therethrough and a shredder mechanism received in the housing, the shredder mechanism including a motor and cutter elements. The shredder mechanism enables the at least one article to be shredded to be fed into the cutter elements and the motor being operable to drive the cutter elements in a shredding direction so that the cutter elements shred the at least one article fed therein into particles. At least one shock absorbing element is also included in the shredder which is configured to connect the shredder mechanism and shredder housing. The shock absorbing element has a first leg connected to the shredder mechanism, a second leg connected to the shredder housing, and a resilient section interconnecting the first and second legs in a spaced apart relation. The at least one shock absorbing element is configured to at least reduce vibrations transmitted from the shredder mechanism to the shredder housing during operation of the shredder.

In some embodiments, the at least one shock absorbing element is configured to provide a clearance between the shredder mechanism and the shredder housing. In some embodiments, the first leg and the second leg are offset from each other.

Other objects, features, and advantages of the present invention will become apparent from the following detailed description, the accompanying drawings, and the appended claims.

DETAILED DESCRIPTION OF THE PREFERRED EMBODIMENT(S)

The following embodiments are described with reference to the drawings and are not to be limiting in their scope in any manner.

Figure 1:
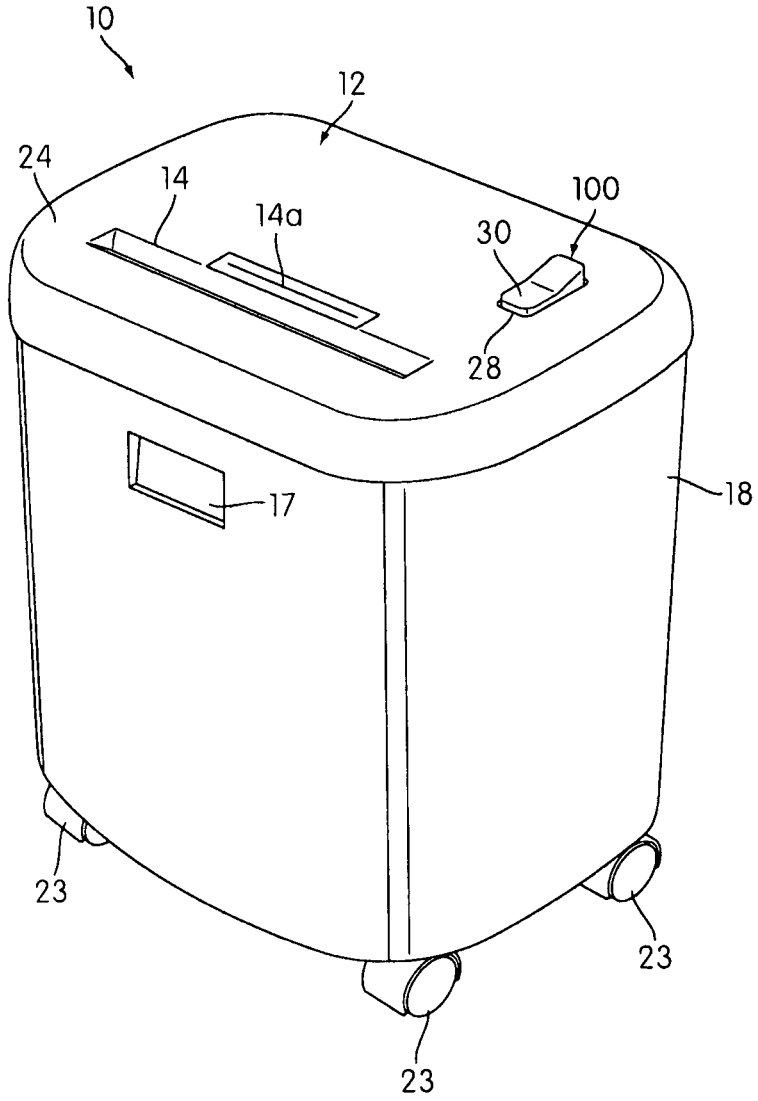
FIG. 1 is a perspective view of a shredder in accordance with an embodiment of the present invention.

FIG. 1 is a perspective view of a shredder apparatus 10 constructed in accordance with an embodiment of the present invention. The shredder 10 is designed to destroy or shred articles such as paper, paper products, CDs, DVDs, credit cards, and other objects. In an embodiment, the shredder 10 may comprise wheels 23 (such as shown in FIG. 1) to assist in moving the shredder 10. The shredder 10 comprises a shredder housing 12 that sits on top of a container 18, for example. The shredder housing 12 comprises at least one input opening 14 on an upper side 24 (or upper wall or top side or top wall) of the housing 12 for receiving materials to be shredded. The input opening 14 extends in a lateral direction, and is also often referred to as a throat. The input opening or throat 14 may extend generally parallel to and above a shredder mechanism 20 (described below). The input opening or throat 14 may be relatively narrow, so as to prevent overly thick items, such as large stacks of documents, from being fed into therein. However, the throat 14 may have any configuration. In some cases, one or more additional or second input openings 14*a* may be provided in shredder housing 12. For example, input opening 14 may be provided to receive paper, paper products, and other items, while second input opening 14*a* may be provided to receive objects such as CDs and DVDs.

Shredder housing 12 also comprises an output opening 16 on a lower side 26 (or bottom side or bottom wall or underside or bin side). In an embodiment, shredder housing 12 may include a bottom receptacle 38 with lower side 26 to receive shredder mechanism 20 therein. Bottom receptacle 38 is affixed to the underside of the upper side 24 or top wall base fasteners, for example. The receptacle 38 has output opening 16 in its bottom side 26 or bottom wall through which shredded particles are discharged. Though lower side 26 is shown as comprising a bottom receptacle 38, the configuration, shape, or design of lower side 26 or receptacle 38 should not be limiting. For example, as shown in FIGS. 6-9, the lower side 26 may comprise a receptacle 38 in the form of a plate. Thus, bottom receptacle 38 is generally defined as a device part of housing 12 for at least assisting in securing the shredder mechanism 20 within and/or to the housing 12. Generally speaking, the shredder 10 may have any suitable construction or configuration and the illustrated embodiments provided herein are not intended to be limiting in any way. In addition, the term "shredder" or "shredder apparatus," used interchangeably throughout this specification, are not intended to be limited to devices that literally "shred" documents and articles, but instead intended to cover any device that destroys documents and articles in a manner that leaves such documents and articles illegible and/or useless.

As noted, the shredder 10 also comprises a shredder mechanism 20 (shown generally in FIG. 3) in the shredder housing 12. When articles are inserted into the at least one input opening or throat 14, they are directed toward and into shredder mechanism 20. "Shredder mechanism" is a generic structural term to denote a device that destroys articles using at least one cutter element. Destroying may be done in any particular way. Shredder mechanism 20 includes a drive system 32 (generally shown in FIG. 2) with at least one motor 34, such as an electrically powered motor, and a plurality of cutter elements 21. The drive system 32 may have any number of motors and may include one or more transmissions. The cutter elements 21 are mounted on a pair of parallel mounting shafts (not shown). The motor 34 operates using electrical power to rotatably drive first and second rotatable shafts of the shredder mechanism 20 and their corresponding cutter elements 21 through a conventional transmission 36 so that the cutter elements 21 shred or destroy materials or articles fed therein, and, subsequently, deposit the shredded materials into opening 15 of container 18 via the output opening 16.

The shredder mechanism 20 may also include a sub-frame 31 for mounting the shafts, motor, and transmission of the drive system 32 and cutter elements 31. In some cases, the subframe 31 may be connected to both an upper side 24 (e.g., on an underside of upper side 24) and a lower side 26 (e.g., on an upper side of receptacle 38) to secure the shredder mechanism 20 within or to the housing 12. For example, one or more connecting portions 40 are provided to secure or fasten the frame 31 thereto. Generally, devices such as fasteners, screws, or bolts, and nuts may be used to secure the frame 31 to the upper side 24 and lower side 26 of housing 12. However, as will be described further below with regard to FIGS. 3-9, at least one shock absorbing element 50 is used to connect the shredder mechanism 20 and shredder housing 12 to assist in at least reducing the transmission of vibrations to the housing 12 when the shredder 10 is in use.

Also, the plurality of cutter elements 21 may be mounted on first and second rotatable shafts in any suitable manner. For example, in an embodiment, the cutter elements 21 are rotated in an interleaving relationship for shredding paper sheets and other articles fed therein. In an embodiment, the cutter elements 21 may be provided in a stacked relationship. The operation and construction of such a shredder mechanism 20 is well known and need not be discussed herein in detail. As such, the at least one input opening or throat 14 is configured to receive materials inserted therein to feed such materials through the shredder mechanism 20 and to deposit or eject the shredded materials through output opening 16.

Figure 2:
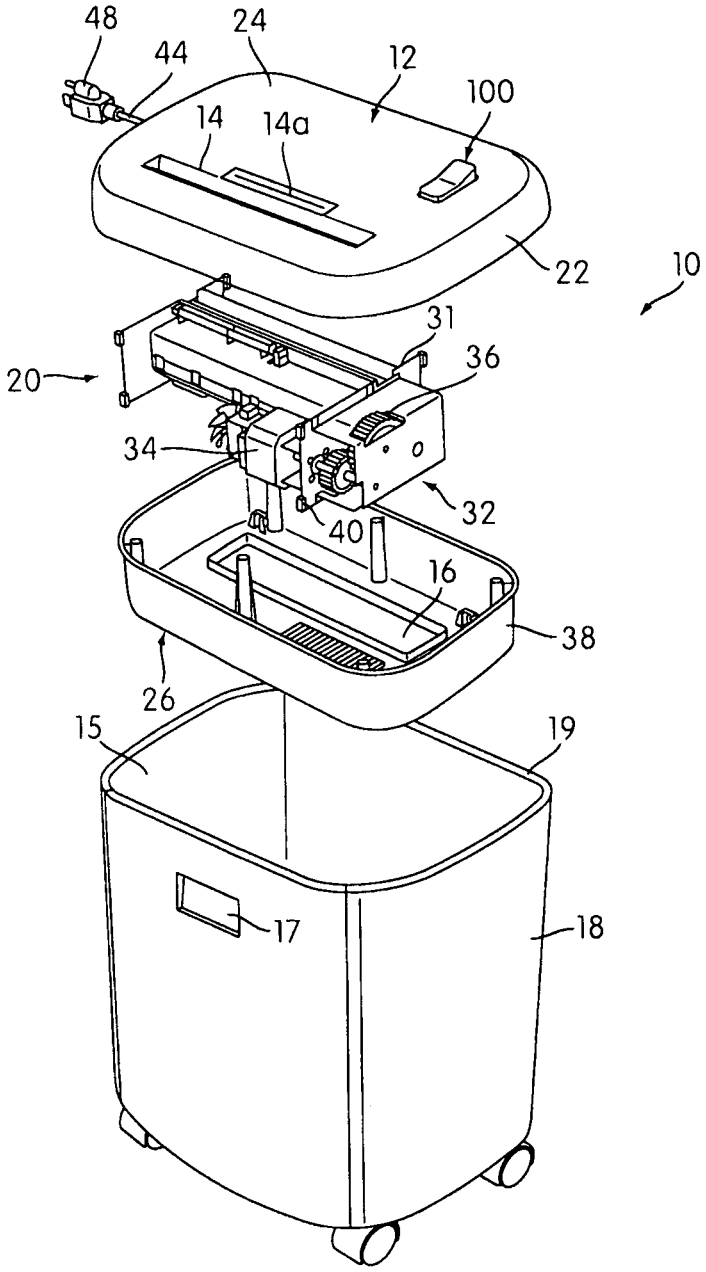
FIG. 2 is an exploded, perspective view of the shredder of FIG. 1.

Shredder housing 12 is configured to be seated above or upon the container 18. As shown in FIG. 2, shredder housing 12 may comprise a detachable paper shredder mechanism. That is, in an embodiment, the shredder housing 12 may be removed in relation to the container 18 to ease or assist in emptying the container 18 of shredded materials. In an embodiment, shredder housing 12 comprises a lip 22 or other structural arrangement that corresponds in size and shape with a top edge 19 of the container 18. The container 18 receives paper or articles that are shredded by the shredder 10 within its opening 15. More specifically, after inserting materials into input opening 14 for shredding by cutter elements 21, the shredded materials or articles are deposited from the output opening 16 on the lower side 26 of the shredder housing 12 into the opening 15 of container 18. The container 18 may be a waste bin, for example.

In an embodiment, the container 18 may be positioned in a frame beneath the shredder housing 12. For example, the frame may be used to support the shredder housing 12 as well as comprise a container receiving space so that the container 18 may be removed therefrom. For example, in an embodiment, a container 18 may be provided to slide like a drawer with respect to a frame, be hingedly mounted to a frame, or comprise a step or pedal device to assist in pulling or removing it therefrom. Container 18 may comprise an opening or recess 17 to facilitate a user's ability to grasp the bin (or grasp an area approximate to recess 17), and thus provide an area for the user to easily grasp to separate the container 18 from the shredder housing 12, thereby providing access to shredded materials. The container 18 may be substantially or entirely removed from being in an operative condition with shredder housing 12 in order to empty shredded materials such as chips or strips (i.e., waste or trash) located therein. In an embodiment, the container or bin 18 may comprise one or more access openings (not shown) to allow for the deposit of articles therein.

Generally the terms "container," "waste bin," and "bin" are defined as devices for receiving shredded materials discharged from the output opening 16 of the shredder mechanism 20, and such terms are used interchangeably throughout this specification. However, such terms should not be limiting. Container 18 may have any suitable construction or configuration.

Typically, the power supply to the shredder 10 will be a standard power cord 44 with a plug 48 on its end that plugs into a standard AC outlet. Also, a control panel may be provided for use with the shredder 10. Generally, the use of a control panel is known in the art. As shown in FIG. 1, a power switch 100 or a plurality of switches may be provided to control operation of the shredder 10. The power switch 100 may be provided on the upper side 24 of the shredder housing 12, for example, or anywhere else on the shredder 10. The upper side 24 may have a switch recess 28 with an opening therethrough. An on/off switch 100 includes a switch module (not shown) mounted to housing 12 underneath the recess 28 by fastening devices, and a manually engageable portion 30 that moves laterally within recess 28. The switch module has a movable element (not shown) that connects to the manually engageable portion 30 to move the switch module between its states. Movement of the manually engageable portion of switch 100 moves the switch module between states. In the illustrated embodiment shown in FIG. 2, the switch module connects the motor 34 to the power supply. This connection may be direct or indirect, such as via a controller. The term "controller" is used to define a device or microcontroller having a central processing unit (CPU) and input/output devices that are used to monitor parameters from devices that at operatively coupled to the controller. The input/output devices also permit the CPU to communicate and control the devices (e.g., such as one or more sensors) that are operatively coupled to the controller. As is generally known in the art, the controller may optionally include any number of storage media such as memory or storage for monitoring or controlling the sensors coupled to the controller.

The controller likewise communicates with the motor 34 of the shredder mechanism 20. When the switch 100 is moved to an on position, the controller can send an electrical signal to the drive of the motor 34 so that it rotates the cutting elements 21 of the shredder mechanism 20 in a shredding direction, thus enabling paper sheets to be fed in the throat 14 to be shredded. Additionally or alternatively, when the switch 100 is in an on position, the switch 100 may be set to an idle or ready position, which communicates with the control panel. The idle or ready position may correspond to selectively activating the shredder mechanism 20, for example. Such a position may allow the controller to selectively enable the operation of the shredder mechanism 20 based on the detection of the presence or insertion of at least one article (e.g., paper) in the throat 14 by or based on a waste level or bin full sensing device. The switch 100 may also be moved to an off position, which causes the controller to stop operation of the motor 34.

The switch module contains appropriate contacts for signaling the position of the switch's manually engageable portion. As an option, the switch 100 may also have a reverse position that signals the controller to operate the motor 34 in a reverse manner. This would be done by using a reversible motor and applying a current that is of reverse polarity relative to the on position. The capability to operate the motor 34 in a reversing manner is desirable to move the cutter elements 21 in a reversing direction for clearing jams, for example. To provide each of the noted positions, the switch 100 may be a sliding switch, a rotary switch, or a rocker switch. Also, the switch 100 may be of the push switch type that is simply depressed to cycle the controller through a plurality of conditions. Additionally, the controller may determine that throat 14 (e.g., via one or more sensors) is not clear of articles, and, thus, operate the motor 34 in a reverse direction (e.g., for a short period of time) so as to clear any remaining articles (or parts thereof) from the throat 14 of the shredder 10.

Generally, the construction and operation of the switch 100 and controller 56 for controlling the motor are well known and any construction for these may be used. For example, a touch screen switch, membrane switch, or toggle switches are other examples of switches that may be used. Also, the switch need not have distinct positions corresponding to on/off/idle/reverse, and these conditions may be states selected in the controller by the operation of the switch. Any of the conditions could also be signaled by lights, on a display screen, or otherwise.

Figure 3:
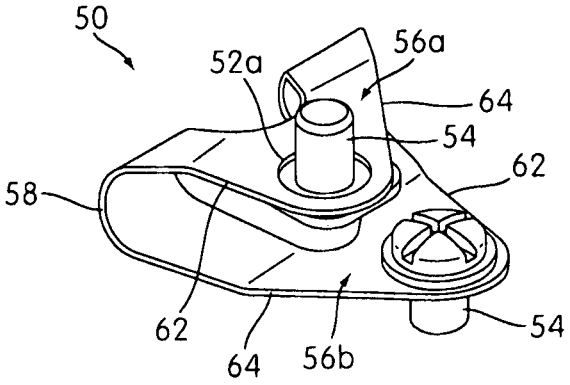
FIGS. 3-5 are perspective, side, and top views, respectively, of a shock absorbing element used with the shredder in accordance with an embodiment of the present invention.
Figure 4:
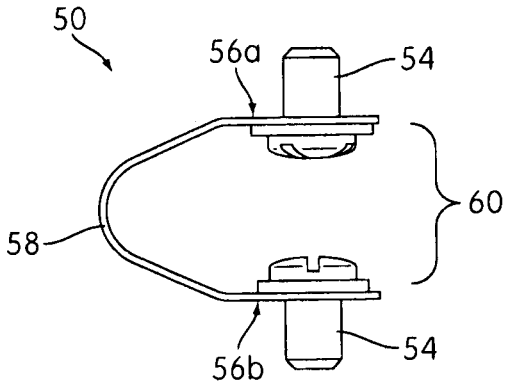
Figure 5:
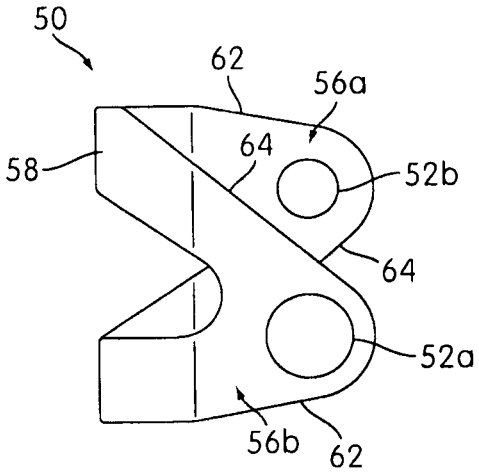

When the shredder 10 is in operation, the cutter elements 21 are rotated about their respective rotatable shafts. In some cases, the rotation or movement of the cutter elements, particularly when shredding one or more articles, may cause at least a part of the shredder mechanism 20 to move or vibrate. Such motion may be transferred from the subframe 31 to the shredder housing 12, for example. In some cases, such as when the bin 18 has accumulated a sufficient amount of shredded particles therein such that it is near full or its capacity, the shredder 10 may be subject to knocking and/or rocking. Each of these reactions (vibrations, knocking, rocking, etc.) as well as the noise associated with such reactions are undesirable. As such, the shredder 10, in accordance with an embodiment, utilizes at least one shock absorbing element 50 as shown in FIGS. 3-5.

The shock absorbing element 50 is configured to connect the shredder mechanism 20 and the shredder housing 12. As shown, the shock absorbing element 50 generally comprises a first leg 56*a* and a second leg 56*b*. The first leg 56*a* may be connected to the shredder mechanism 20 and the second leg 56*b* may be connected to the shredder housing 12, or vice versa. The at least one shock absorbing element 50 is configured to at least reduce vibrations transmitted from the shredder mechanism 20 to the shredder housing 12 during operation of the shredder.

The first and second legs 56*a* and 56*b* may each contain a connection opening 52*a* and 52*b*, respectively, to assist in connecting the shock absorbing element 50 to the shredder housing 12 and shredder mechanism 20. As shown in FIG. 4, for example, fasteners 54 may be insert through connection openings 52*a* and 52*b* such that legs 56*a*, 56*b* may be used as connection devices. Of course, bolts, nuts, or other attachment mechanisms may also be used to attach element 50 to the housing 12 and mechanism 20. Additionally or alternatively, it is also envisioned that openings 52*a* and 52*b* may not be present and other devices may be used for attaching element 50. Thus, the method of attaching or securing shock absorbing element 50 to the shredder 10 should not be limiting.

The shock absorbing element 50 may also further comprise a resilient section 58. In some embodiments, the first leg 56*a* and second leg 56*b* are interconnected via resilient section 58. For example, as shown in FIG. 4, the resilient section 58 may comprise a rounded edge comprising a radius so as to allow first and second legs 56*a* and 56*b* to be in planes generally parallel to each other. In some cases, the resilient section 58 may be in the form of a "C"-shaped clip or connecting device with ends 56*a* and 56*b*. The resilient section 58 may provide a spacing 60 or clearance between the first and second legs 56*a* and 56*b*. Thus, the shock absorbing element 50 may be configured to provide a clearance 60 between the shredder mechanism 20 and the shredder housing 12 when assembled so as to place the first and second legs 56*a* and 56*b* in a spaced apart relation. The shock absorbing element 50 may dynamically fix the shredder housing 12 and shredder mechanism 20 relative to each other such that the clearance 60 allows relative movement. In some cases, the shock absorbing element 50 may provide a clearance 60 between the first and second legs 56*a* and 56*b* without the use of resilient section 58. Dimensions for the spacing or clearance 60 between the shredder mechanism 20 and housing 12 should not be limiting.

The first and second legs 56*a* and 56*b* may generally comprise an edge 62 extending at a first angle and another edge 64 extending at a second angle. In some embodiments, the first and second legs 56*a* and 56*b* may be offset from each other. In some cases, such an offset may provide greater stability between the housing 12 and shredder mechanism 20 with respect to sideways or lateral motion. The first leg 56*a* may be provided in a plane that is substantially parallel to a plane of the second leg 56*b*; however, the opening 52*a* of the first leg 56*a* may be designed to be offset from the opening 52*b* of the second 56*b*, such as shown in FIG. 5. In some embodiments, the openings 52*a* and 52*b* may comprise different sizes or radiuses, for example. In some cases, the openings 52*a* and 52*b* may comprise similar radii. The sizes of the openings 52*a* and 52*b* should not be limiting.

In some embodiments, such as shown in FIGS. 3 and 5, the resilient section 58 may include an opening or a cutout section 66. More specifically, the resilient section 58 may comprise two legs separated by the cutout section 66. The design of the resilient section 58 and cutout section 66 provide flexibility to the shock absorbing element 50, so that it may assist in absorbing forces or vibrations with respect to the shredder mechanism 20 and housing 12. However, the design of the resilient section 58 should not be limiting. For example, it is envisioned that an opening or cutout 66 of different size may be provided, or not provided at all.

Figure 6:
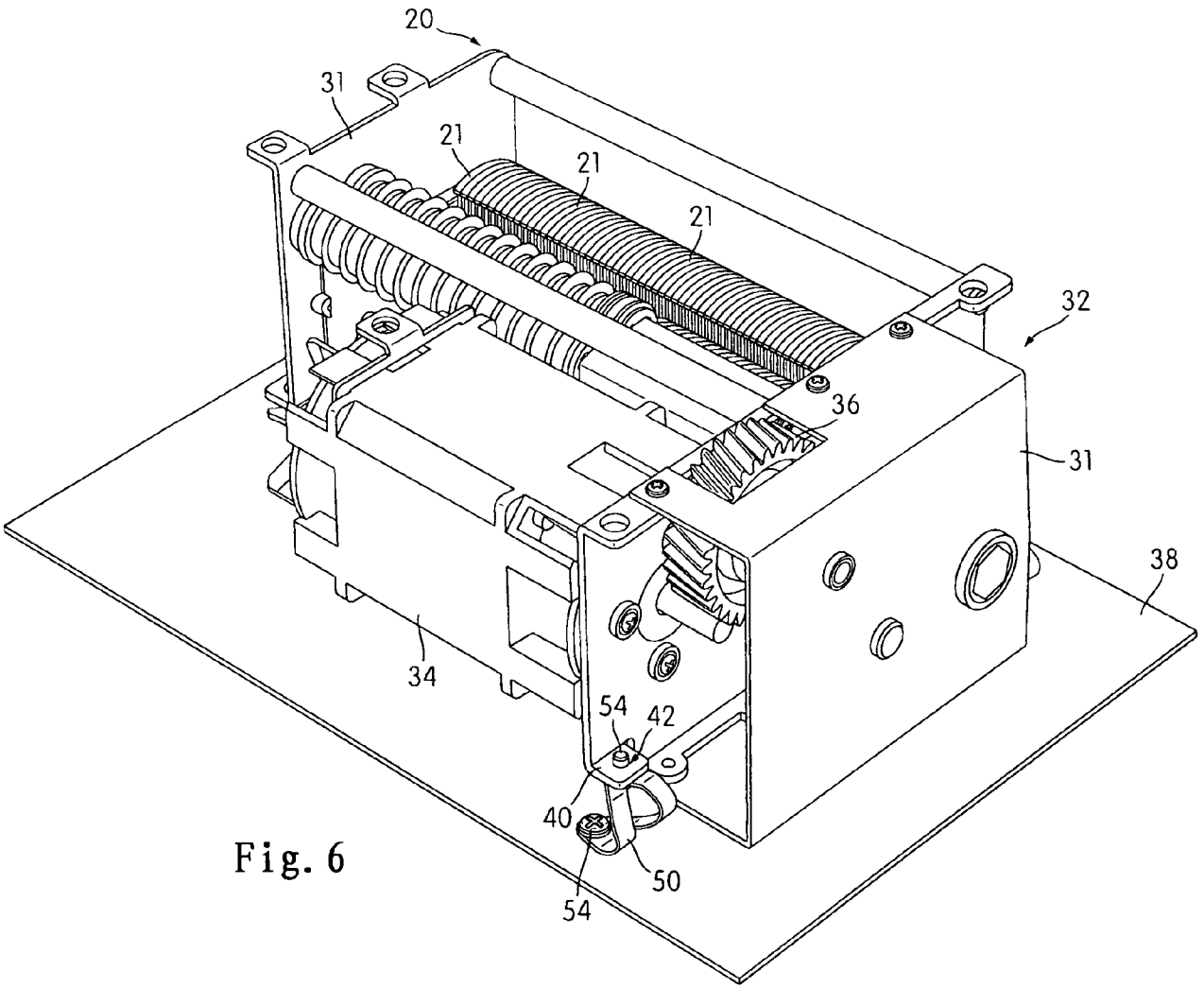
FIGS. 6-9 illustrate perspective and side view of the shock absorbing element of FIGS. 3-5 in the shredder of FIG. 1 in accordance with an embodiment of the present invention.
Figure 7:
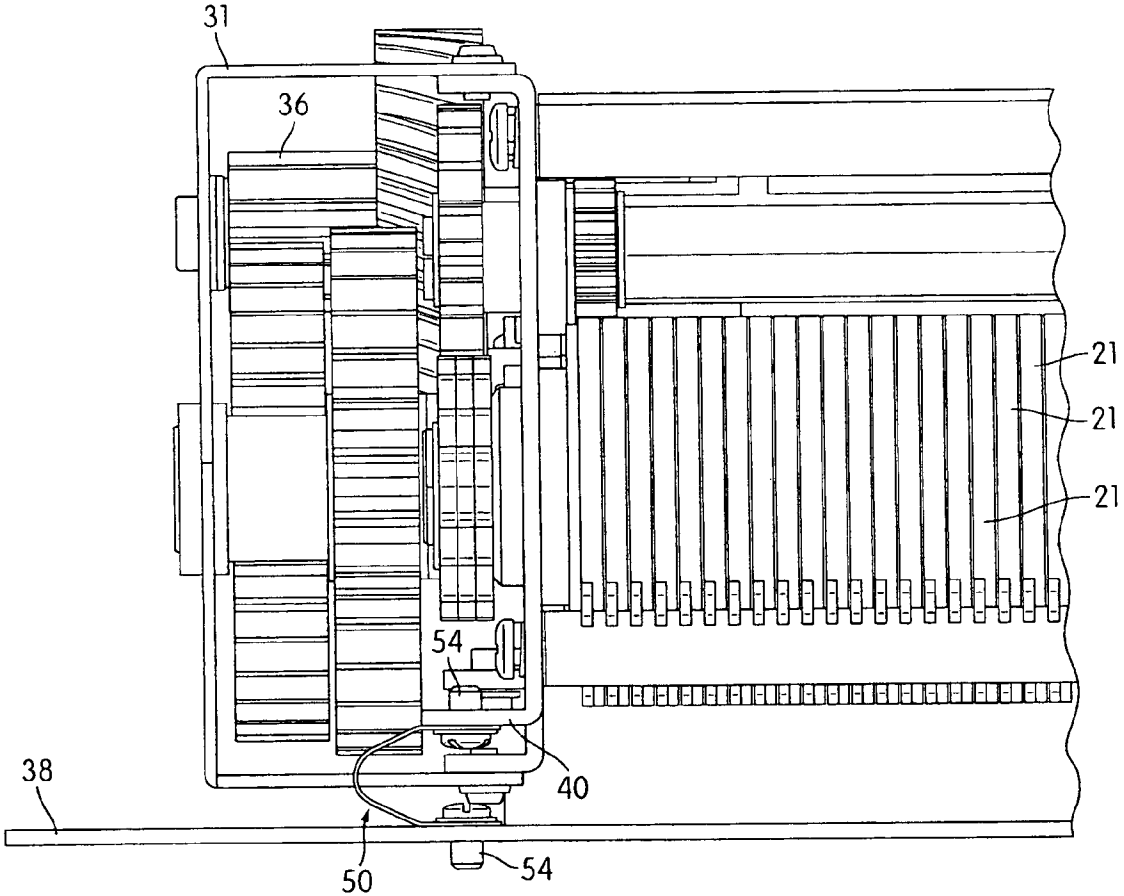
Figure 8:
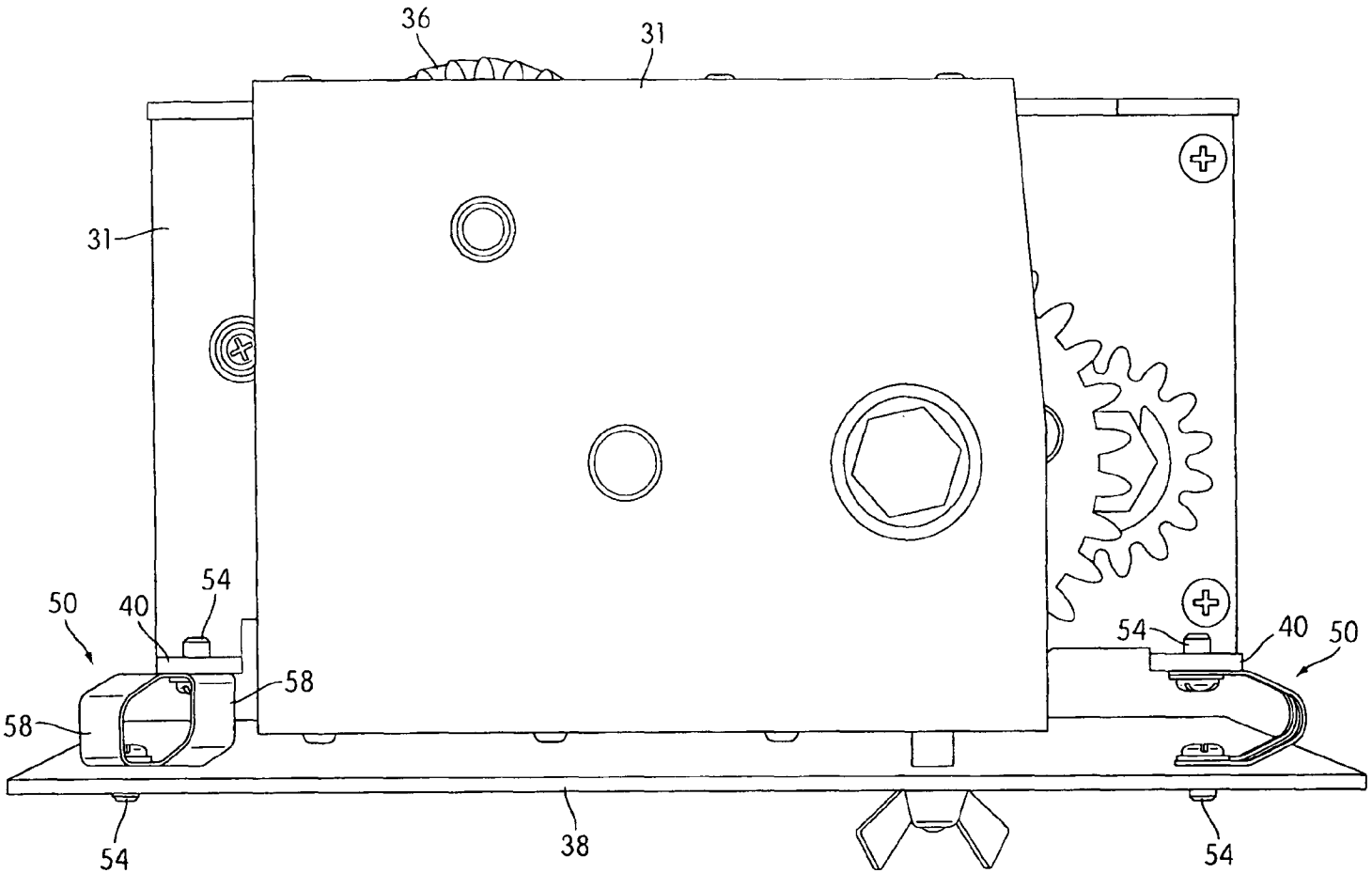
Figure 9:
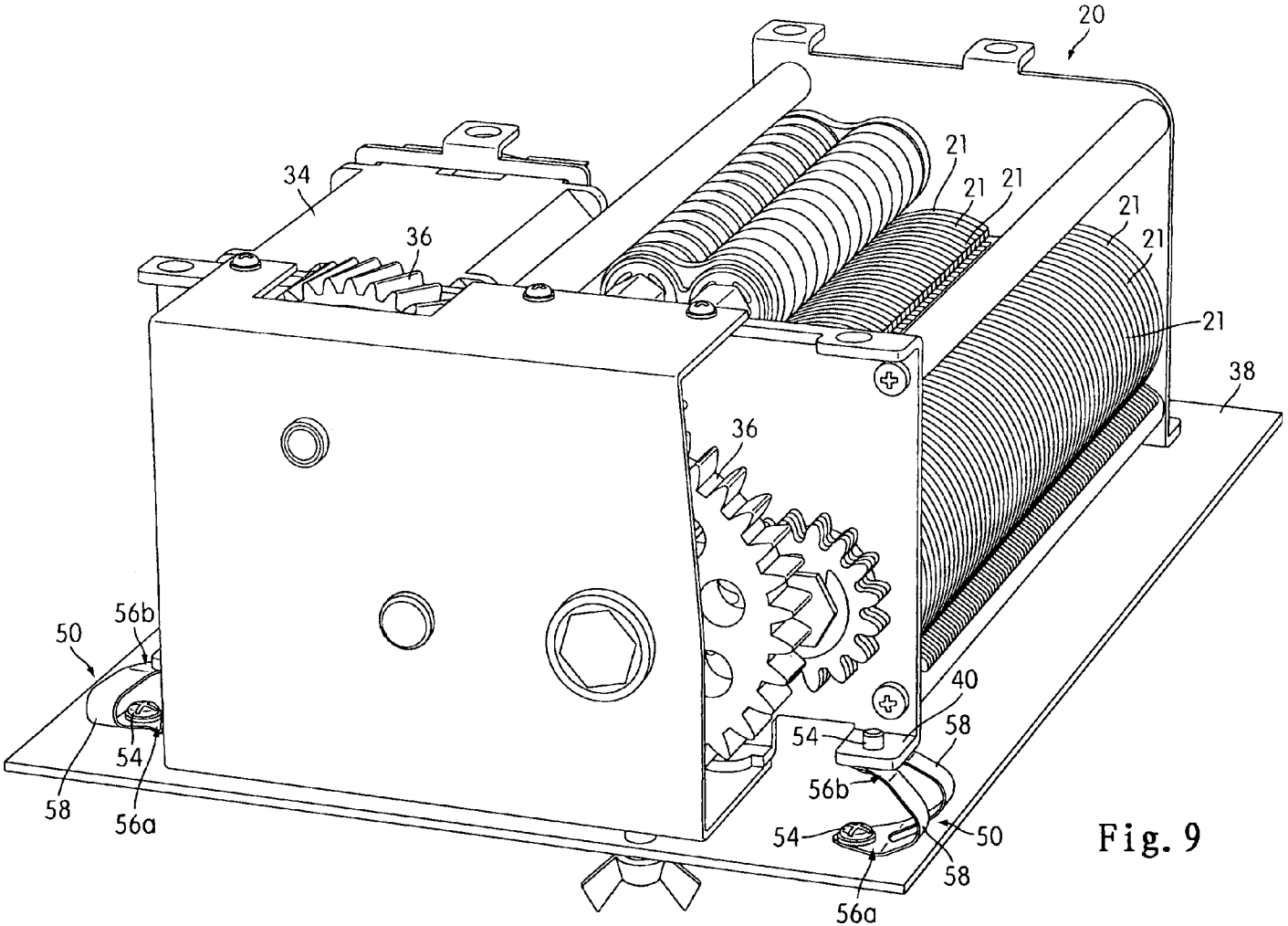

The at least one shock absorbing element 50 may be connected to a connecting portion 40 of the shredder mechanism 20. For example, one or more connecting portions 40 may be provided near the corners on a bottom and/or top side of the shredder mechanism, as illustrated in FIGS. 6 and 9, for example. As such, a shock absorbing element 50 may be connected to one or more of the connecting portions 40 of the shredder mechanism 20 and to the shredder housing 12 using fasteners 54, for example. As shown in FIGS. 6-9, when a shock absorbing element 50 is attached thereto, the shredder mechanism 20 and housing 12 have a clearance 60 therebetween. Thus, the shock absorbing element 50 assists in isolating the shredder mechanism 20 from contact with the housing 12 (or other surrounding elements).

The shock absorbing element 50 may be formed from several methods and materials. For example, it is envisioned in an embodiment that the element 50 is formed via a stamping method from sheet steel. However, such methods and materials should not be limiting.

The shock absorbing element 50 as described assists in providing several improvements over the prior art. For example, the shock absorbing element 50 itself is used to connect the shredder mechanism 20 and the shredder housing 12 together, thereby assisting in directly or indirectly in reducing or eliminating the transmission of vibrations during operation of the shredder 10. Also, as noted above, by forming the shock absorbing element 50 with the resilient section 58 as described, a spacing or clearance 60 is provided between the first and second legs 56*a* and 56*b* to thereby substantially isolate the shredder mechanism 20 from the housing 12. Such isolation thereby assist in reducing or eliminating the transmission of vibrations from the shredder mechanism to the housing 12, bin 18, or other parts of the shredder 10. As such, noise is reduced and stability of the shredder is improved.

The legs 56*a* and 56*b* of the shock absorbing element allow for easy assembly of the machine (shredder 10). Also, the resilient section 58 provides flexibility between the housing 12 and shredder mechanism 20.

Additionally, the shock absorbing element 50 as described may be connected to existing connection portions 40 or attachment points in shredders. Thus, the shock absorbing element 50 may be used with existing shredders to thereby reduce vibrations and/or noise.

While the principles of the invention have been made clear in the illustrative embodiments set forth above, it will be apparent to those skilled in the art that various modifications may be made to the structure, arrangement, proportion, elements, materials, and components used in the practice of the invention.

The type of shredder 10 that the shock absorbing element 50 is applied to should not be limiting. For example, the shock absorbing element may be applied to shredders comprising lift-off shredder housings. Also, the shredder 10 may comprise a shredder mechanism 20 and cutter elements 21 of many configurations. The above mechanism may be implemented in all cross cut machines and strip cutting machines.

Additionally, one or more shock absorbing elements 50 may be used in cooperation with one or more sensor devices in the shredder 10. Such sensor devices may be devices that are capable of, but not limited to, detecting that the bin or container 18 is full of accumulated shredded particles, detecting that the shredder mechanism should be activated (e.g., by inserting article(s) into throat 14), determining a maximum thickness (e.g., to indicate that the thickness of at least one article being inserted into the throat 14 is at least equal to a predetermined thickness), detecting movement of the container 18, detecting shredded materials located in or around the output opening 16, detecting power of the shredder 10 or whether the shredder mechanism 20 is switched on or off, and/or detecting and indicating that the output opening 16 is restricted or closed. Also, sensor devices may be used in cooperation with any number of mechanical, electromechanical, or electric devices. For example, in the case of a sensor for detecting movement of the container, if the waste container or bin 18 is removed from the shredder housing 12, the shredder mechanism 20 will not operate.

In some embodiments, any number of visual or audible signals in the form of lights or alarms, for example, may be used in cooperation with the shredder. For example, it is envisioned that such signals may be used under circumstances such as indicating that the bin is full. Any suitable indicator may be used.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A shredder comprising:

a shredder housing having a throat for receiving at least one article to be shredded therethrough;

a shredder mechanism received in the housing, the shredder mechanism including a motor and cutter elements, the shredder mechanism enabling the at least one article to be shredded to be fed into the cutter elements and the motor being operable to drive the cutter elements in a shredding direction so that the cutter elements shred the at least one article fed therein into particles;

at least one shock absorbing element configured to connect the shredder mechanism and shredder housing, the shock absorbing element being generally "C"-shaped and comprising a first leg connected to the shredder mechanism, a second leg connected to the shredder housing, and a resilient section interconnecting the first and second legs in a spaced apart relation, and the at least one shock absorbing element configured to at least reduce vibrations transmitted from the shredder mechanism to the shredder housing during operation of the shredder, wherein the first leg and the second leg are offset from each other in a first dimension, a second dimension, and a third dimension.

2. The shredder according to claim 1, wherein the at least one shock absorbing element is configured to provide a clearance between the shredder mechanism and the shredder housing.

3. The shredder according to claim 1, wherein the first leg and second leg each comprise a connection opening, and wherein the first leg and the second leg are connected via fasteners inserted through the connection openings.

4. The shredder according to claim 3, wherein the connection opening of the first leg is horizontally offset from the connection opening of the second leg.

5. The shredder according to claim 1, wherein the resilient section comprises a rounded edge having a radius.

6. The shredder according to claim 1, wherein the resilient section comprises a cutout section forming at least two resilient legs interconnecting the first and second legs.

7. The shredder according to claim 1, wherein each of the first leg and the second leg comprising an edge extending at a first angle and another edge extending at a second angle.

8. The shredder according to claim 1, wherein the at least one shock absorbing element is configured to provide a clearance between the shredder mechanism and the shredder housing.

9. The shredder according to claim 8, wherein the connection opening of the first leg is horizontally offset from the connection opening of the second leg.

10. The shredder according to claim 1, wherein the first leg and the second leg are offset from each other.

11. The shredder according to claim 1, wherein the first leg and second leg each comprise a connection opening, and wherein the first leg and the second leg are connected via fasteners inserted through the connection openings.

12. The shredder according to claim 1, wherein the resilient section comprises a rounded edge having a radius.

13. The shredder according to claim 1, wherein the resilient section comprises a cutout section forming at least two resilient legs interconnecting the first and second legs.

14. A shredder comprising:

a shredder housing having a throat for receiving at least one article to be shredded therethrough;

a shredder mechanism received in the housing, the shredder mechanism including a motor and cutter elements, the shredder mechanism enabling the at least one article to be shredded to be fed into the cutter elements and the motor being operable to drive the cutter elements in a shredding direction so that the cutter elements shred the at least one article fed therein into particles;

at least one shock absorbing element configured to connect the shredder mechanism and shredder housing, the shock absorbing element being generally "C"-shaped and comprising a first leg connected to the shredder mechanism, a second leg connected to the shredder housing, and a resilient section interconnecting the first and second legs in a spaced apart relation, each of the first leg and the second leg comprising a first edge extending from the resilient section at a first angle and another second edge extending from the resilient section at a second angle, the second angle being different than the first angle, and the at least one shock absorbing element configured to at least reduce vibrations transmitted from the shredder mechanism to the shredder housing during operation of the shredder.

* * * * *